United States Patent [19]

Grate

[11] 4,084,873

[45] Apr. 18, 1978

[54] LAMP AND HOLDER COMBINATION WITH ADAPTER

[76] Inventor: Anton J. Grate, 3211 Burr Oaks Rd., Joliet, Ill. 60435

[21] Appl. No.: 723,096

[22] Filed: Sep. 14, 1976

[51] Int. Cl.[2] ..... H01R 33/08

[52] U.S. Cl. ..... 339/52 R; 339/56

[58] Field of Search ..... 339/50–57; 240/51.11 R, 51.11 A

[56] References Cited

U.S. PATENT DOCUMENTS

| | | | |
|---|---|---|---|
| 2,412,826 | 12/1946 | Mills | 339/55 |
| 2,742,620 | 4/1956 | Pistey | 339/52 S |
| 3,466,594 | 9/1969 | Detch | 339/54 |

*Primary Examiner*—Roy Lake
*Assistant Examiner*—Mark S. Bicks
*Attorney, Agent, or Firm*—John L. Parker

[57] ABSTRACT

An improved lamp, holder and adapter are provided, the lamp including an elongated body and lamp bases at each end of the body, and the holder for the lamp comprising a frame and a pair of end sockets adapted to receive the lamp bases. Each lamp base includes a plug carrying a pair of spaced electrical conductors for detachable connection to corresponding conductors within the end sockets, the latter being connected to a suitable source of electric current. At least one of the sockets includes an irregularly shaped socket recess, and at least one of the lamp plugs has a groove therein. An adapter element is provided interposed between the grooved lamp plug and the socket having the irregularly shaped recess, with the adapter carrying a tongue on one side sized and shaped to lockingly nest within the plug groove and having its opposite side shaped complementary to the socket recess for locking mating engagement therewith. Several lamp plug groove shapes and arrangements are described.

4 Claims, 12 Drawing Figures

LAMP AND HOLDER COMBINATION WITH ADAPTER

DESCRIPTION OF THE INVENTION

This invention relates to an improved lamp, holder and adapter combination, and particularly to such an arrangement for use with fluorescent lamps. Fluorescent lamps, usually of elongated tubular shape, are filled with gases which ionize under the influence of an electric current to radiate unpolarized light.

My invention is particularly applicable to 800 milliamp size fluorescent lamps used to provide internal illumination for large commercial and industrial signs. Typically, such signs comprise a metal frame covered with large, translucent outer sign panels illuminated by a plurality of fluorescent lamps located behind the panels and within the frame. Most of such large signs are located outdoors, where bi-pin style lamp bases cannot be used because moisture and exposure to other atmospheric contaminants tend to cause corrosion of the pins and consequent electrical shorting.

Instead, the style of fluorscent lamp described and shown in the instant patent application is particularly useful. These lamps are of the "rapid start" type, operating on high voltage and do not require a starter. Most conventional fluorescent lamps of this type carry protruding plug contacts at their bases, which snap into spring loaded lamp sockets. These plug contacts are usually oblong in shape, project from the lamp bases, and are hollow having the lamp conductor terminals recessed within them. In this way, exposure of the terminals to the atmosphere may be minimized.

But, there is a tendency in such arrangements for the lamp socket springs either to become displaced from center or, with time, to weaken through wear. Inasmuch as the oblong protruding plugs at each end of such a conventional lamp are aligned with one another, the displacement or weakening of the socket springs may cause the lamp to tilt in one direction, with consequent loss of good electrical contact between lamp and socket. The untoward effects of poor electrical contact include lamp burn-outs and socket burn-outs, eventually causing the ballast to burn-out, and making for an expensive repair.

Frequently when such tilting action takes place between the lamp base and its socket, an arcing will occur between the electrical contacts in the base and those in the socket causing the contact points in the base and socket to fuse together. In this event, both the base and the socket must be replaced. Another problem resulting from poor electrical contact occurs when the wire leading from the lamp base to the ballast wire short-circuits, many times causing a direct short to the lamp holder or frame and endangering a serviceman attempting to make repairs. Such electrical short-circuits also reduce the life of the ballast, and may cause the ballast to catch fire or explode.

It is a principal object of this inventin to assure improved electrical contact between lamp and holder, thereby avoiding lamp, socket and ballast burn-outs and eliminating short circuit hazards to repairmen. An associated object is to avoid the burn-out problems of conventional lamps by equalizing the pressure and tension between the electrical contacts within each of the lamp ends or bases and its corresponding socket.

Another object of the invention is to improve the physical and electrical mating connection between a fluorescent lamp base and its holder. An allied object is to provide an improved lamp and holder which extends the usable life of the lamp and socket, and in the case of signs and fixtures extends the life of the wiring and ballast within the sign or fixture.

Other objects and advantages of the present invention will become apparent upon reading the following detailed description and upon reference to the drawings, in which.

Figure 1:
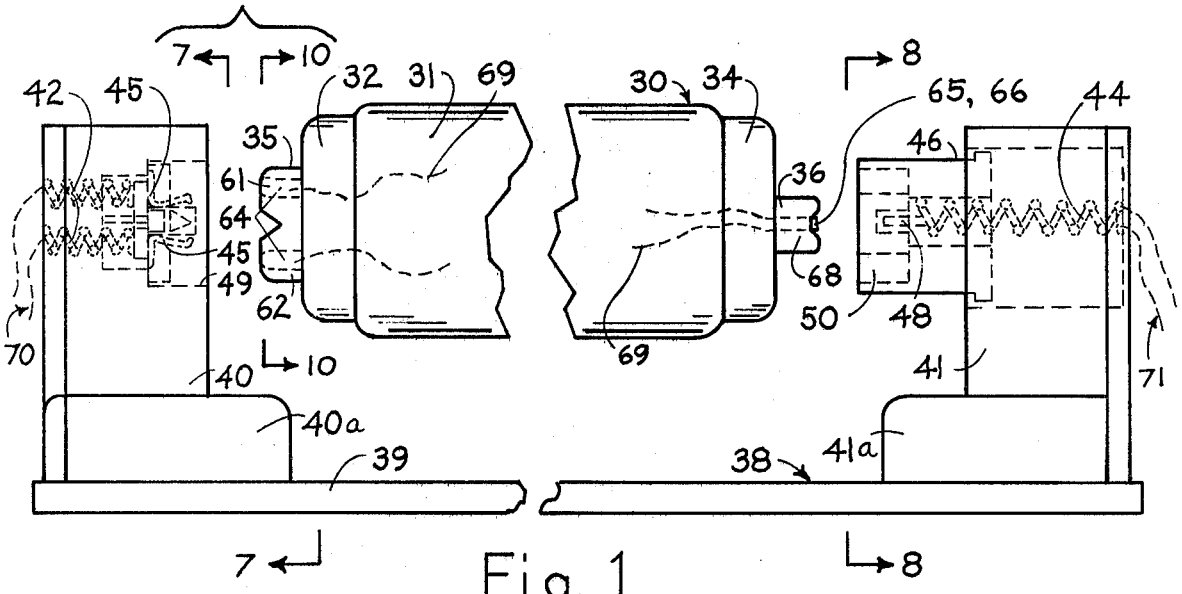
FIG. 1 is a side elevational view showing the ends of an illustrative fluorescent lamp prior to installation in a lamp holder which may be used in practicing the invention.
Figure 7:
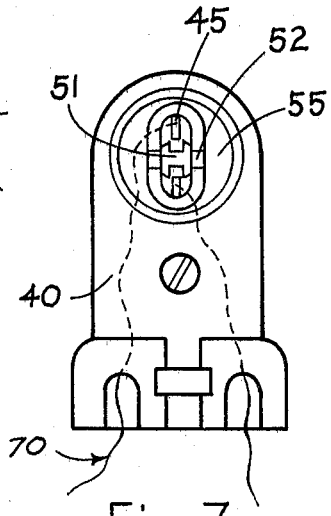
Figure 8:
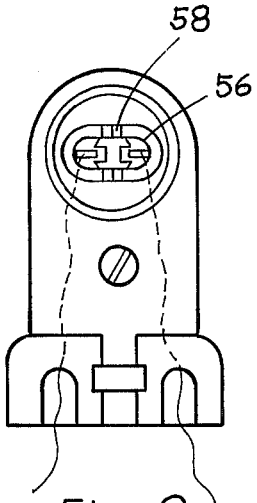
Figure 2:
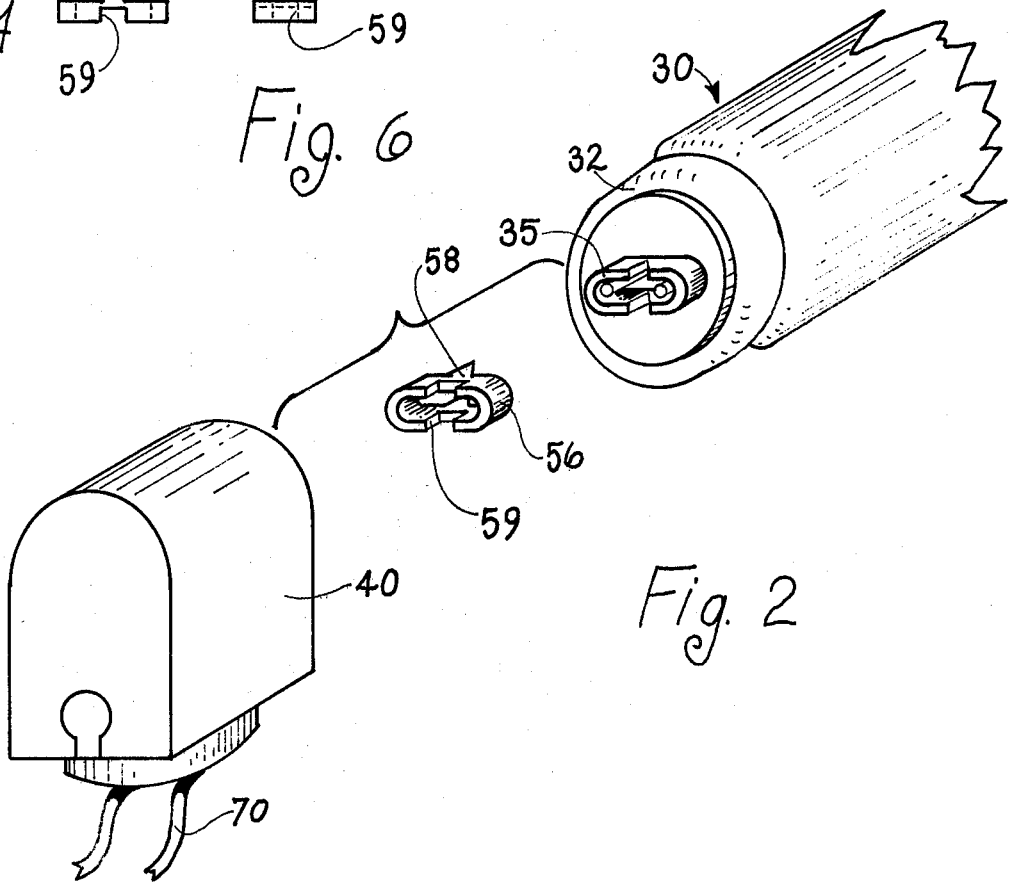
FIG. 2 is an exploded, fragmentary perspective view showing the relationship between an illustrative adapter element which may be used in carrying out the invention, the end of a conventional fluorescent lamp, and a typical lamp socket.
Figure 3:
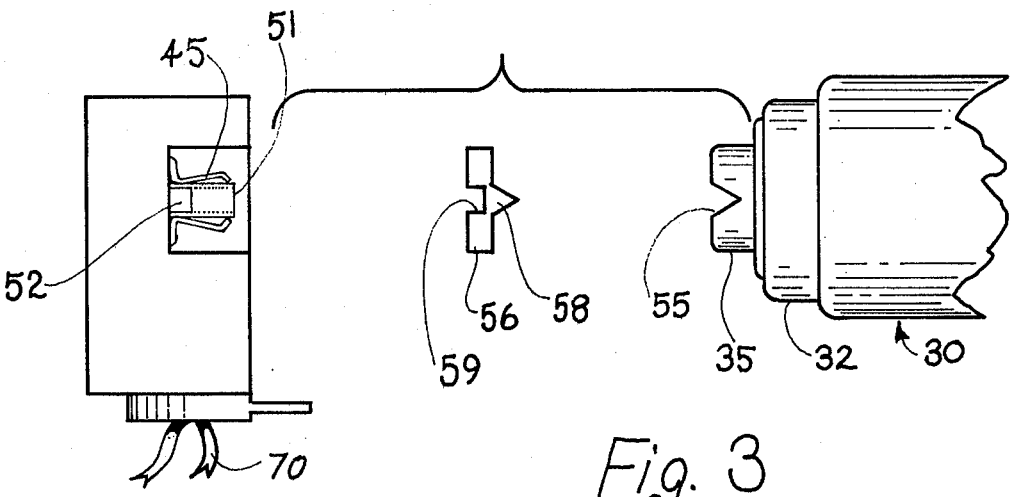
FIG. 3 is an exploded, fragmentary, elevational view corresponding generally to FIG. 2.

FIGS. 7 and 8 are end elevational views of the socket portions of an illustrative lamp holder for use with the lamp form shown in FIGS. 2 and 3. FIG. 7 shows the socket recess prior to, and FIG. 8 after, placement of the adapter element within the recess. FIG. 8 is taken along the line 8—8 in FIG. 1.

Figure 9:
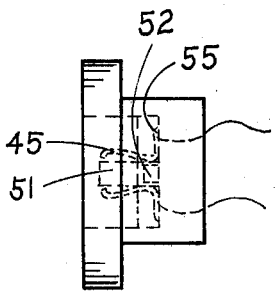

FIG. 9 is a side elevational view of the socket shown in FIG. 7.

Figure 10:
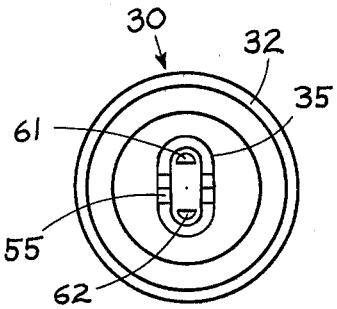

FIG. 10 is an end elevational view of one end of the illustrative lamp taken along the line 10—10 in FIG. 1.

Figure 11:
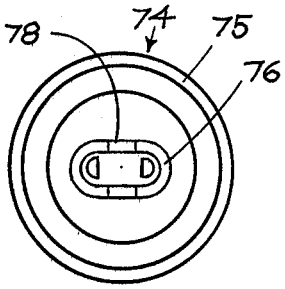

FIG. 11 is an end elevational view, similar to FIG. 10 but showing the lamp plug disposed at a 90° angle to the configuration of FIG. 10, depicting an alternative form of the invention.

Figure 12:
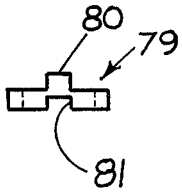
Figure 5:
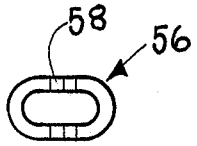
FIGS. 4, 5 and 6 are side elevational, plan and end elevational views, respectively, of an illustrative adapter element which may be used in carrying out the invention.
Figure 4:
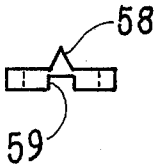
Figure 6:
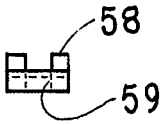

FIG. 12 is a side elevational view of an alternative form of adapter element corresponding to the lamp plug depicted in FIG. 11.

While the invention is described in connection with certain preferred embodiments, it will be understood that I do not intend to limit the invention to those embodiment. On the contrary, I intend to cover all alternatives, modifications and equivalents as may be included within the spirit and scope of the invention as defined by the appended claims.

Turning now to the drawings, an illustrative lamp 30 is shown in FIG. 1 including a lamp body 31, a lamp base 32, 34 at each end of the body, a plug 35, 36 protruding from each lamp base, and a holder 38 for the lamp comprising a frame 39 and a pair of end sockets 40, 41 adapted to receive the bases 32, 34, respectively, of the lamp. The frame 39 may, in the case of a lighted sign, be associated with the bottom, side or back of the sign, or with an internal wire-carrying raceway.

As shown, the end sockets 40, 41 are of the recessed contact "tombstone" type, including pedestal portions 40*a*, 41*a* suitably secured to the holder frame 39. The sockets shown are constructed for snap-in reception of the lamp plugs. In this instance, the end sockets 40, 41 are spring loaded to facilitate snap action. Coil springs 42, 44, respectively, are provided in suitable recesses within the end sockets for biasing either a pair of spring type electrical contacts 45 (left side of FIG. 1) or a telescopable extension 46 (right side of FIG. 1) carrying a pair of electrical contacts 48. With each of the end sockets 40, 41, the electrical contacts are disposed within recesses 49, 50, respectively, sized and shaped to receive the lamp plugs 35, 36.

Typically, the illustrative socket recess 49 is irregularly shaped, being generally oblong to match the contour of the illustrative lamp plugs, including an upstanding central post 51 separating the two contacts 45, and having a crossbar portion 52 at the base 54 of the recess to provide added support for the post 51 (see FIGS. 7, 9). Usually these sockets are molded of plastic or the like.

In carrying out the invention, at least one of the lamp plugs 35, 36 and corresponding socket recesses 49, 50 is specially constructed to improve the physical and electrical mating connection between the lamp and its holder, and adapter means is provided therebetween to give assurance of an especially positive mating engagement between lamp and socket. As shown generally in FIGS. 2 and 3, the typically oblong lamp plug 35 is provided with a groove 55 arranged, in this instance, transverse to the principal axis of the plug. The groove 55 extends parallel to the longitudinal axis of the lamp body 31 and has a width less than the circumference of the plug 35 or 36. As shown in FIGS. 1 – 6, the groove 55 takes the form of a V-notch.

In the invention, an adapter element 56 is provided for interposition between the grooved lamp plug 35 and the corresponding socket recess 49 to provide for locking, mating engagement between the plug and recess. As illustrated in FIGS. 1 – 6, the adapter element 56 is of generally hollow, oblong cylindrical shape to fit the contour of the socket recess 49, and carries an upstanding tongue or projection 58 on one end extending within the outer boundaries of the cylinder and sized and shaped to lockingly nest within the groove 55 in the plug 35. To this end, the tongue 58 is of pointed, V-shape for complementing and closely interfitting the corresponding V-shape of the groove 55. These special, complementary shapes bring about secure and positive physical locking between the adapter 56 and plug 35 when the lamp and holder have been assembled.

The adapter element 56 also includes means for closely interfitting with the irregularly shaped socket recess 49. Thus, the end of the adapter 56 opposite the tongue 58 is provided with a channel or pocket 59 sized and shaped to lockingly ffit over the crossbar portion 52 of the socket recess 49. In this instance, because the crossbar 52 has a square or rectangular cross-section the channel 52 is correspondingly shaped as a square or rectangular pocket. When the adapter 56 has been placed with the socket recess 49 (see especially left side of FIG. 1 and FIG. 8), the adapter channel 59 closely overfits the socket crossbar 52 so that the adapter in effect becomes locked within the socket.

In this way, the locking arrangement between lamp plug and socket has been completed. The adapter 56 is tightly locked within the socket recess 49 via the interfitting adapter channel 59 and socket crossbar 52, and the lamp plug 35 is similarly locked to the adapter via the interfit between adapter tongue 58 and plugg groove 55.

This construction is found to provide a degree of physical stability between plug and socket heretofore unattained through use of conventional lamp and socket arrangements. The adapter tongue 58 and channel 59 configuration provides additional contact surface area between plug and socket which minimizes tilting action between the lamp base and its socket, and which consequently avoids ballast burn-outs and short circuits.

Of course, the groove 55 in the lamp plug 35 may have various alternative shapes and arrangements (one alternative is illustrated in FIGS. 11 and 12, and described below). For example, the groove may be arranged angularly with respect to the long axis of the plug, or multiple grooves may be used (i.e. a sawtooth arrangement). The groove itself may have straight or curved walls. In effect, any suitable depression or the like in the plug contour will function as the groove described herein connection with my invention.

Likewise, the base 54 of the socket recess may have an alternate contour to that described above. Whatever irregularity is used or found within the recess, the channel 59 provided on the adapter element may be suitably sized and shaped to closely overfit the recess irregularity.

It is thus seen that the adapter element 56 itselt may take various shapes useful in practicing the invention. The adapter tongue 58 will be sized and shaped to correspond to whatever type groove or the like is provided on the lamp plug, and the adapter channel 59 will be similarly constructed to overfit whatever recess irregularity is encountered.

Returning to FIG. 1, the illustrative lamp 30 includes a pair of vertically spaced conductors 61, 62 mounted on bars 64 in one of its plug ends 35 (left side of FIG. 1), and a pair of horizontally spaced conductors 65, 66 similarly mounted on bars 68 in its other plug end 36. Internal wires 69 within the lamp body are connected to the conductors 61, 62, 65 and 66 for ionizing the gases within the lamp.

Thus it will be seen that when the lamp 30 has been inserted in the holder 38, the vertically oriented conductors of the lamp plug 35 fit within the end socket 40 and the horizontally oriented conductors of the lamp plug 36 fit within the other end socket 41. Electrical contact is established between the conductors 61, 62 and their corresponding socket contacts 45 on the one hand, and between the conductors 65, 66 and their corresponding socket contacts 48 on the other hand. Suitable electrical wires 70, 71 are provided for external connection of the end sockets 40, 41 to a suitable source of electric current (not shown).

An alternative form of the invention is shown in FIGS. 11 and 12. There, the end of the illustrative lamp 74 includes a lamp base 75, and a protruding lamp plug 76 (see FIG. 11). In this form of the invention, the plug groove 78 is square or rectangular in shape. That is, the groove here is similar to the embodiment of FIGS. 1 – 6, except that instead of being notch shaped it is square or rectangular channel shaped. The width of this groove 78 may vary from a narrow slot to the wider channel shown in FIGS. 11 and 12. As shown in FIG. 12, the alternative form of the adapter element 79 includes a square or rectangular tongue 80 on its upper side, and a channel 81 on its underside similar to that shown in FIGS. 1 – 6. In spite of these differences in contour between plug groove 78 and adapter tongue 80, the function of the embodiment of the invention depicted in FIGS. 11 – 12 is the same as that of FIGS. 1 – 6.

One of the features of the invention is that a conventional lamp plug may be quickly and easily modified for use with an adapter element in carrying out the invention. Thus, a conventional oblong lamp plug may be easily cross-cut with a saw or file to provide the necessary plug groove.

Of course, for volume production it will be feasible to manufacture the lamps so that their plugs have the necessary groove contour, and to manufacture the lamp sockets so that their recesses are provided with a contour, like that of the adapter, to meet and interfit that of the grooved plugs.

In use, the adapter element of the invention may be simply manually placed over the end of a fluorescent lamp plug which has been grooved in accordance with invention. When the adapter element is thus interposed between one of the grooved lamp plugs and its respective socket, all of the advantages of the invention may be attained. The adapter element may be made of plastic or other suitable material.

Other possible variations include orienting the plugs carried by a single lamp differently with respect to each other, and/or spacing the two electric conductors in one lamp plug apart in one direction while spacing the conductors in the other plug apart in a different direction (with the electrical contacts within the end sockets being correspondingly directionally oriented to receive the lamp conductors), e.g. see the opposite ends of the lamp shown in FIG. 1, FIGS. 7 and 8, and FIGS. 10 and 11.

As will be apparent, the invention may be used with lamps of all sizes and degrees of brightness. And the invention is applicable not only to the lamps described herein having recessed double contacts at their ends, but to any exposed bi-pin or other lamp having a double conductor contact.

Through use of the invention, it has been found that lamp changing problems are minimized and the frequency and severity of service calls is reduced because of the improvement obtained in tension and pressure between the lamp and its holder sockets.

I claim as my invention:

1. An improved fluorescent lamp, holder and adapter combination comprising an elongated, tubular lamp body, a generally flat base secured to each end of said body, each of said bases carrying a plug extending outwardly therefrom and including a pair of spaced electrical conductors, a lamp holder carrying a pair of spaced sockets each adapted to receive one of said plugs, one of said sockets including an irregularly shaped socket recess, one of said lamp plugs having a groove therein extending parallel to the longitudinal axis of said lamp body and having a width less than the circumference of said plug, an adapter element interposed between said one of said lamp plugs and said one of said sockets, said adapter element being generally shaped as an oblong cylinder and carrying a tongue on one end extending within the outer boundaries of the cylinder and sized and shaped to lockingly nest within said groove in said plug and having its opposite end shaped complementary to said irregularly shaped socket recess for locking, mating engagement therewith, and means for providing electrical current to said lamp holder sockets and to said electrical conductors when the lamp is in place within the holder.

2. An improved fluorescent lamp, holder and adapter as defined in claim 1, in which said plug groove is V-shaped and said adapter tongue is correspondingly V-shaped.

3. An improved fluorescent lamp, holder and adapter as defined in claim 1, in which said plug groove is rectangular in cross-section and said adapter tongue is correspondingly rectangular in cross-section.

4. An improved fluorescent lamp, holder and adapter as defined in claim, in which said irregularly shaped socket recess includes a crossbar portion of generally rectangular cross-section and said opposite end of the adapter element is provided with a correspondingly shaped channel portion.

* * * * *